US007338303B1

(12) United States Patent
Yi et al.

(10) Patent No.: US 7,338,303 B1
(45) Date of Patent: Mar. 4, 2008

(54) CARD CONNECTOR ASSEMBLY HAVING CARRIAGE COMPONENT

(75) Inventors: Chong Yi, Mechanicsburg, PA (US); James M. Sabo, Harrisburg, PA (US); Kevin E. Walker, Hershey, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/634,490

(22) Filed: Dec. 6, 2006

(51) Int. Cl.
*H01R 11/22* (2006.01)

(52) U.S. Cl. ..... 439/267

(58) Field of Classification Search ..... 439/260, 439/267, 635
See application file for complete search history.

(56) References Cited

U.S. PATENT DOCUMENTS 3,569,905 A * 3/1971 Kehagioglou ..... 439/197
3,587,031 A * 6/1971 Flavin et al. ..... 439/260
3,639,888 A * 2/1972 Pittman et al. ..... 439/260
3,651,144 A * 3/1972 Desso et al. ..... 439/141
4,118,094 A * 10/1978 Key ..... 439/635
5,002,496 A * 3/1991 Fox, Jr. ..... 439/197
6,213,804 B1 4/2001 Matsumura
6,413,108 B2 * 7/2002 Centofante ..... 439/267
6,416,342 B2 * 7/2002 Matsumura ..... 439/267
6,431,890 B1 * 8/2002 Li et al. ..... 439/160
6,824,410 B1 * 11/2004 Co et al. ..... 439/260
7,014,487 B2 3/2006 Ishikawa
2007/0032114 A1 * 2/2007 Sanders et al. ..... 439/260

* cited by examiner

*Primary Examiner*—Briggitte Hammond
*Assistant Examiner*—Larisa Tsukerman
(74) *Attorney, Agent, or Firm*—Wei Te Chung

(57) ABSTRACT

A card connector assembly (100) for insertion of an electronic card (6), includes an insulative housing defining a cavity, two rows of terminals (4), a pair of springs (3), and a carriage component (2) being moveable between two rows of the terminals and having a pair of projection portions formed at two opposite ends thereof. The carriage component is movable along with the inserted electronic card from an initial position toward a final position where the carriage component is held stationary.

13 Claims, 8 Drawing Sheets

CARD CONNECTOR ASSEMBLY HAVING CARRIAGE COMPONENT

BACKGROUND OF THE INVENTION

1. Field of the Invention

The present invention relates to a card connector assembly, and particularly to a card connector assembly detachably receiving an electronic card.

2. Description of Related Art

A connector assembly described in U.S. Pat. No. 7,014,487 was issued on Mar. 21, 2006. The connector assembly comprises an insulative housing and an electronic card having a plurality of conductive traces. The insulative housing has an elongated slot for insertion of the electronic card, a connecting member formed at a lower portion of the elongated slot for resisting against an edge of the electronic card, and a plurality of terminals each having a contact portion clasping the conductive traces of the electronic card. The electronic card is inserted into the elongated slot until reaching the connecting member, the contact portions of the terminals then make contact with the conductive traces of the electronic card. The electronic card is then locked in the elongated slot above the connecting portion, due to an engagement between the terminals and conductive traces thereof.

The contact portions of the terminals are deflected inwardly for clasping the inserted electronic card. When a distance between a pair of corresponding contact portions is smaller than a thickness of the electronic card, it is hard to insert the electronic card between the pair of contact portions.

Another connector described in U.S. Pat. No. 6,213,804 was issued on Apr. 10, 2001. The connector for receiving a semiconductor component comprises a housing defining an insertion slot for insertion of the semiconductor component, a plurality of terminals assembled lengthwise along opposite sides of the insertion slot, and a driving mechanism. The driving mechanism comprises a carriage for keeping the contact portions of the terminals away from an insertion position of the semiconductor component, when the semiconductor component is not inserted in the insertion slot. The carriage has a recess defined at a lower portion thereof for retaining a spring. When the semiconductor component is inserted into the connector, the carriage is pushed downwardly and the spring is compressed.

The recess defined in the carriage would weaken the carriage and complicate manufacture of the carriage.

Hence, an improved card connector assembly is required to overcome the above-mentioned disadvantages of the related art.

SUMMARY OF THE INVENTION

A primary object of the present invention is to provide a card connector assembly having a carriage component having a firm and simple configuration.

To achieve the aforementioned objects, a card connector assembly for insertion of an electronic card comprises an insulative housing defining a cavity, two rows of terminals assembled to opposite inner sides of the insulative housing, a carriage component being moveable between the two rows of terminals and having a pair of projection portions formed at two opposite ends thereof, and a pair of springs assembled between the projection portions and the insulative housing. Each terminal is formed with a contact portion. The carriage component is movable along with the electronic card from an initial position toward a final position where the carriage component is held stationary.

The carriage component has a pair of projection portions formed at opposite sides thereof for resisting against the springs. The projection portions would not weaken the carriage component and it is easy to form the projection portions, during the process of manufacturing the carriage component.

Other objects, advantages and novel features of the invention will become more apparent from the following detailed description of a preferred embodiment when taken in conjunction with the accompanying drawings.

BRIEF DESCRIPTION OF THE DRAWINGS

FIG. 1 is an assembled perspective view of a card connector assembly in accordance with the present invention, with an electronic card being fully inserted in;

FIG. 6 is a partially assembled perspective view of a first insulative housing and a carriage component as shown in FIG. 2, with the electronic card being partially inserted in;

DETAILED DESCRIPTION OF THE INVENTION

Figure 1:
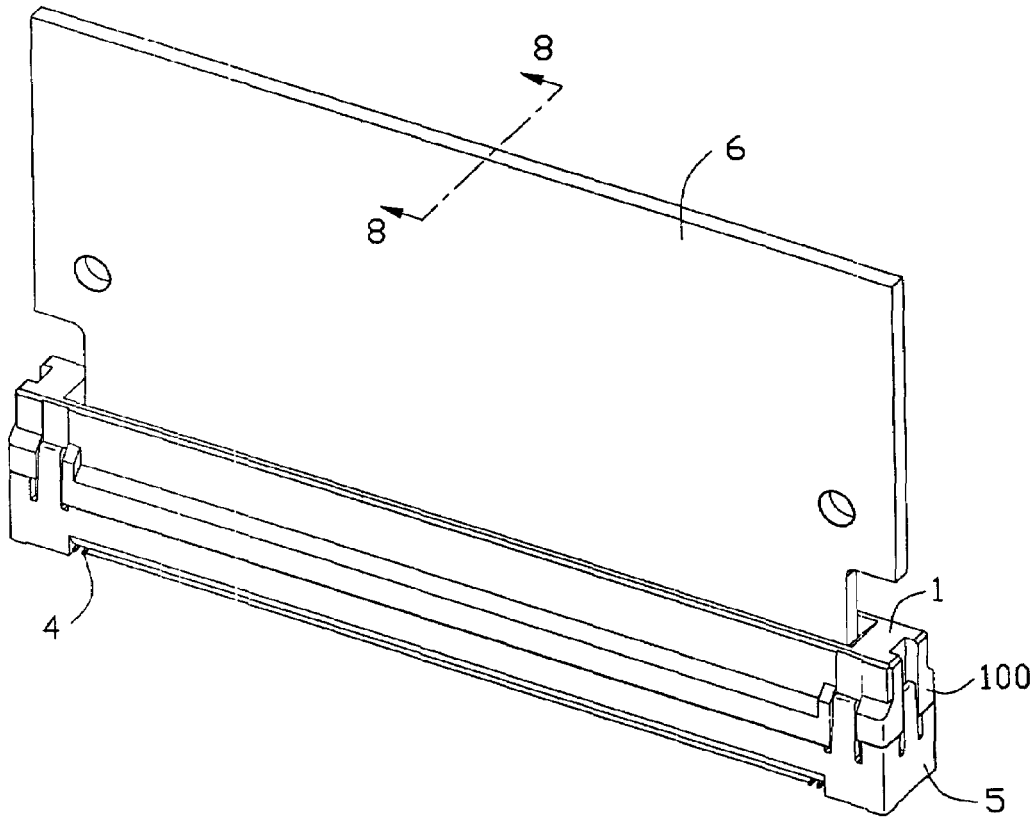

Reference will now be made to the drawing figures to describe the present invention in detail. Referring to FIGS. 1-6, a card connector assembly 100 in accordance with the preferred embodiment of the present invention is adapted for insertion of an electronic card 6. The card connector 100 comprises an insulative housing (not labeled) having a first insulative housing 1 defining an elongated first slot 14, and a detachable second insulative housing 5 defining an elongated second slot 53. The card connector comprises two rows of terminals 4 assembled to opposite inner sides of the first and the second insulative housings 1, 5, a carriage component 2 moveably mounted between the first slot 14 and the second slot 53, and a pair of coil springs 3 compressed between the carriage component 2 and the second insulative housing 5.

Figure 2:
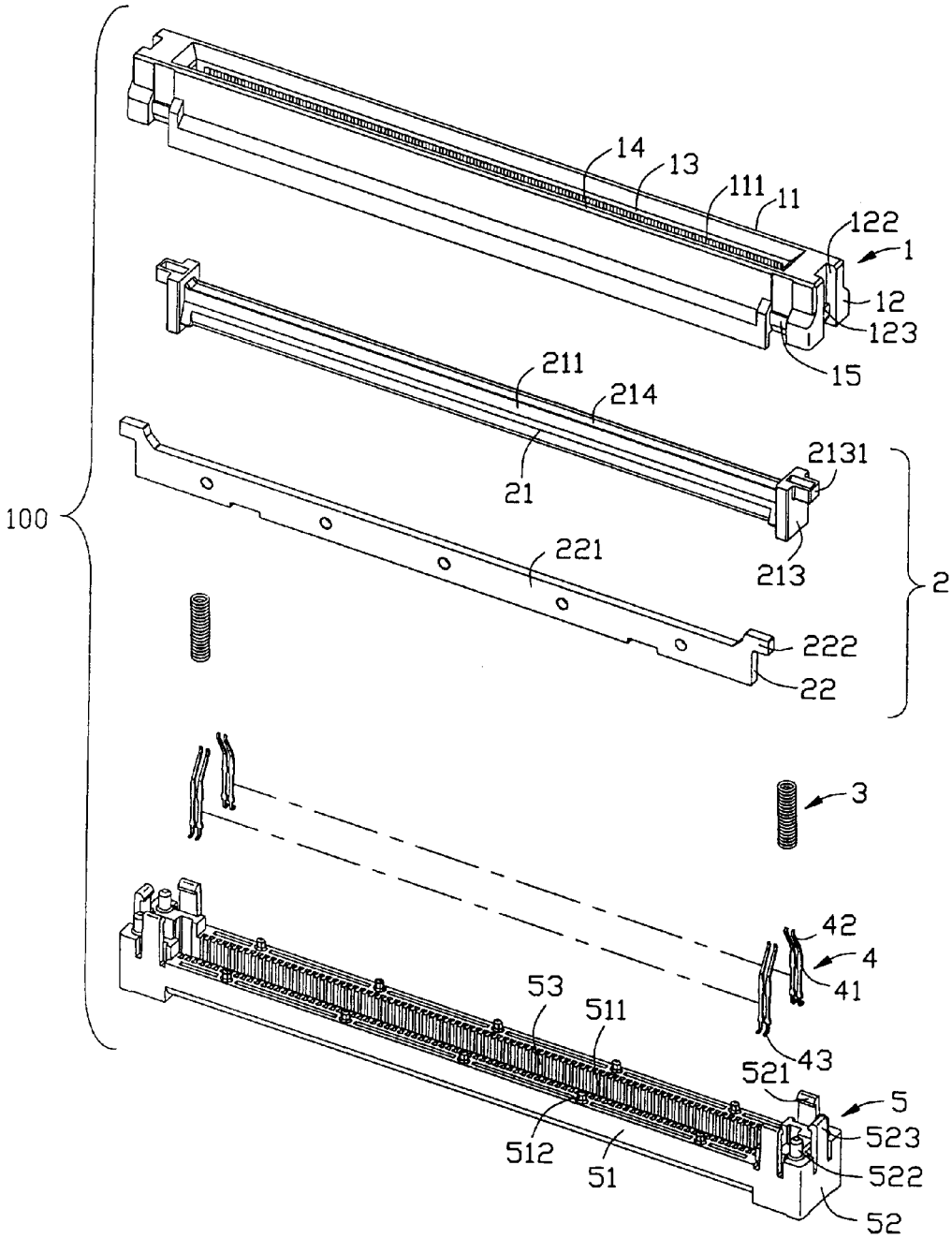
FIG. 2 is an exploded perspective view of the card connector assembly as shown in FIG. 1.
Figure 3:
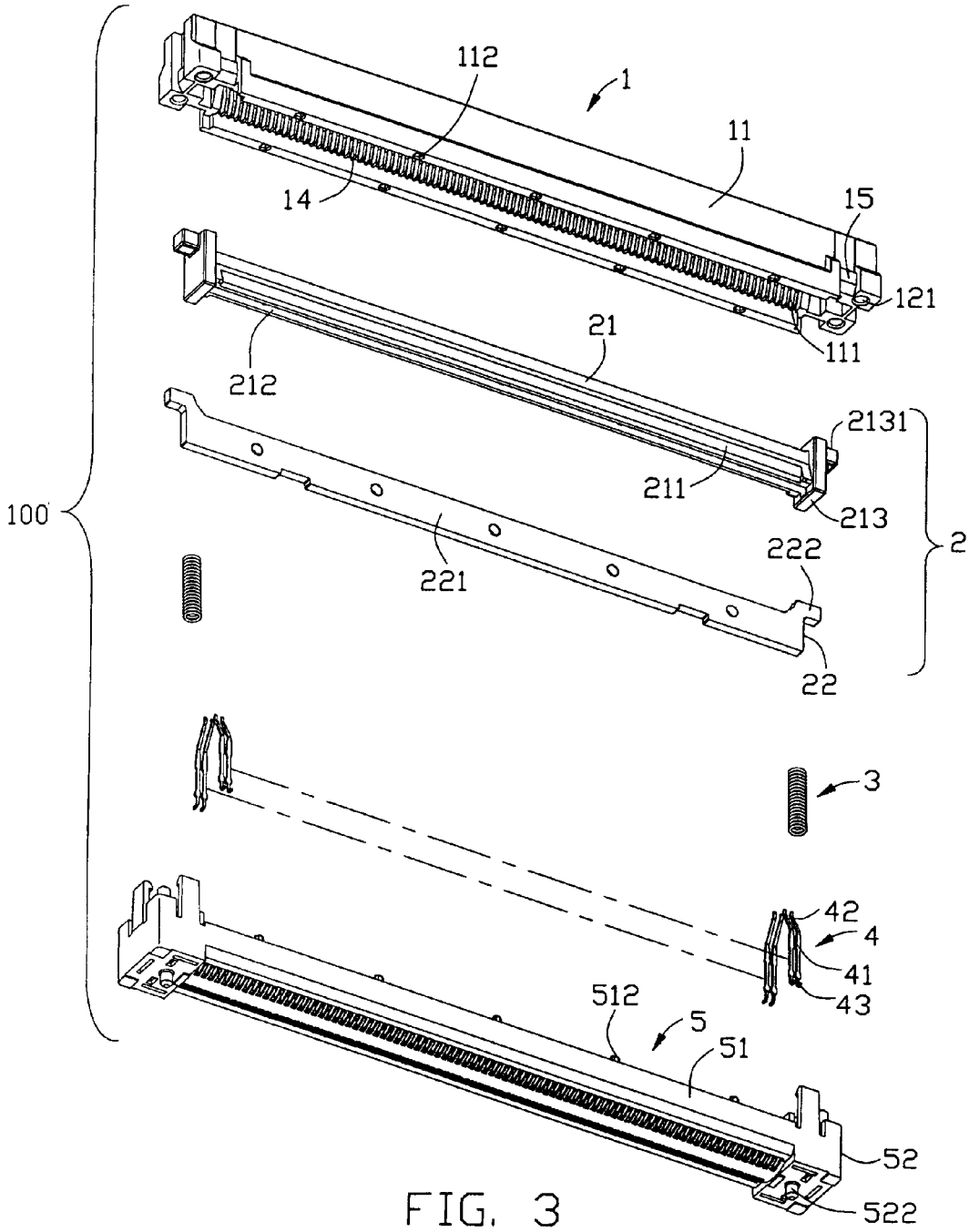
FIG. 3 is an exploded perspective view similar to FIG. 2, taken from another aspect.

Referring to FIGS. 2, 3, the first insulative housing 1 has an opening 13 defined at an upper portion thereof for communicating with the first slot 14, a pair of rectangular primary walls 11 and a pair of combined portions 12 interconnected together for surrounding the first slot 14. Inner faces of the periphery walls 11 respectively define thereon a plurality of first passageways 111 extending in a top-to-bottom direction and communicating with the first slot 14. The periphery walls 11 comprise two pairs of first locking portions 15 formed on opposite ends thereof and a plurality of receiving indentations 112 defined on bottom surfaces thereof. The combined portion 12 comprises a groove 122 defined on an outer surface thereof, a first hook 123 retained in the groove 122, and a pair of circular indentations 121 defined on a bottom surface thereof.

The second insulative housing 5 comprises a pair of elongated side walls 51 and a pair of connection portions 52 interconnected together for encircling around the second slot 53. Inner faces of the side walls 51 have a plurality of second passageways 511 defined in a top-to-bottom direction and preferably communicating with the first passageways 111 for insertion of the terminals 4. The side walls 51 comprise two pairs of second locking portions 521 formed on opposite ends thereof and a plurality of protrusions 512 formed on top surfaces thereof. The connection portion 52 has a second hook 523 and a pair of posts 522 projecting upwardly from an upper portion thereof.

Figure 7:
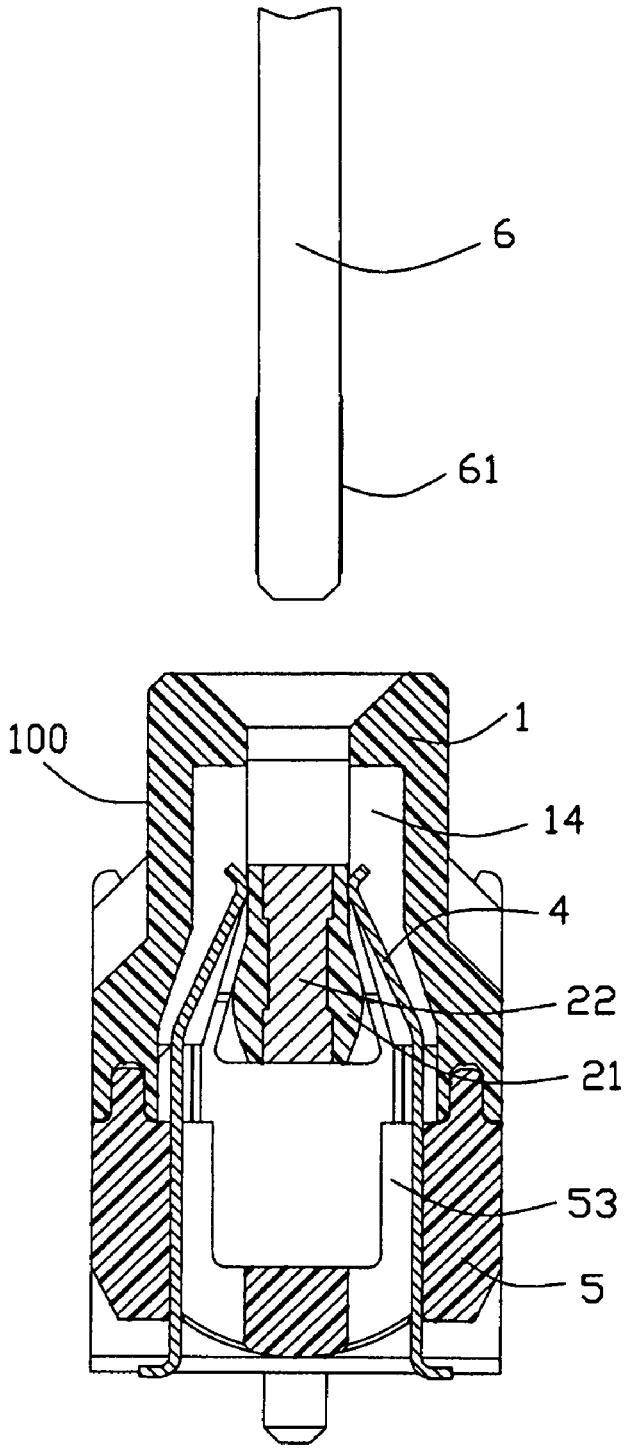
FIG. 7 is a cross-sectional view of the card connector assembly as shown in FIG. 1 but showing the electronic card being apart therefrom, taken along line 8-8, when the electronic card is not inserted therein.
Figure 8:
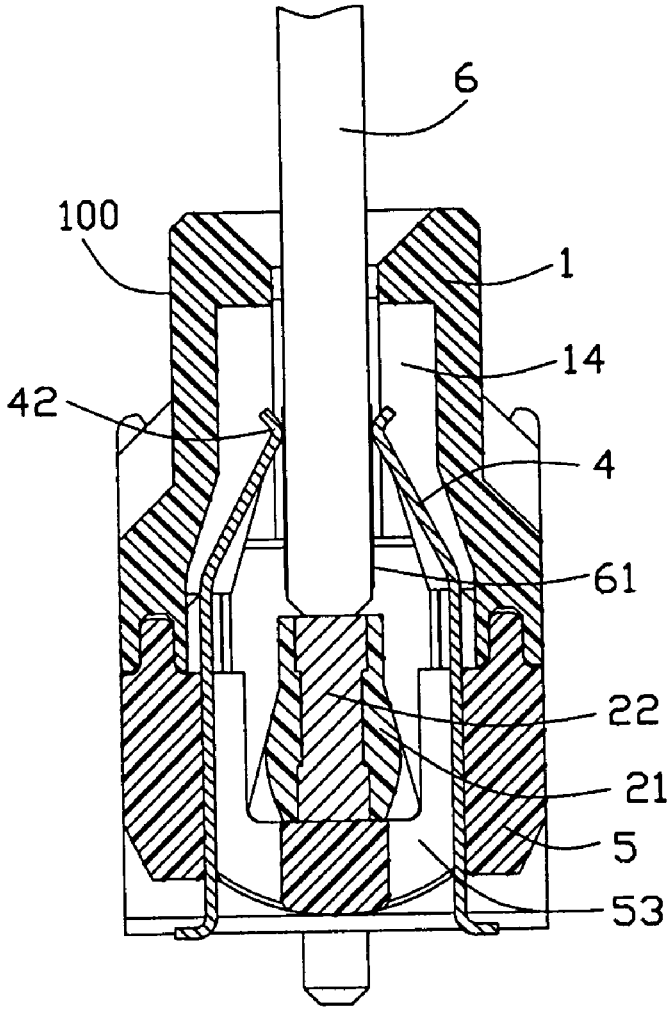
FIG. 8 is a cross-sectional view of the card connector assembly as shown in FIG. 1, taken along line 8-8, when the electronic card is fully inserted therein.

The carriage component 2 includes a moveable portion 21 defining an elongated insertion recess 212 and a stiffener portion 22 inserted in the insertion recess 212 for reinforcing the moveable portion 21. It is noted that, in the preferred embodiment shown, the stiffener portion 22 is insert molded with the moveable portion 21, as clearly seen in FIGS. 7 and 8, although in FIGS. 2 and 3 the two portions 21 and 22 are shown as separate for clarity purposes. The carriage component 2 comprises a top face 214, which as can be understood may be provided by the moveable portion 21 or by the stiffener portion 22 as shown in FIGS. 7 and 8, a pair of primary faces 211 extending downwardly from opposite edges of the top face 214, and a pair of connection ends 213 respectively at side edges of the primary faces 211. The connection ends 213 are optionally formed with a pair of outwardly extending first ear portions 2131 thereon. The stiffener portion 22 has a rectangular body portion 221. Optionally, a pair of second ear portions 222 may project outwardly from the body portion 221 for engaging with the first ear portions 2131 of the moveable portion 21. One of the optional first and second pair of ear portions 2131 and 222 is required for cooperating with the pair of springs 3, as will be further described later.

Each terminal 4 comprises a body portion 41, a contact portion 42 extending upwardly from one end of the body portion 41, and a soldering portion 43 generally perpendicular to another end of the body portion 41.

Figure 4:
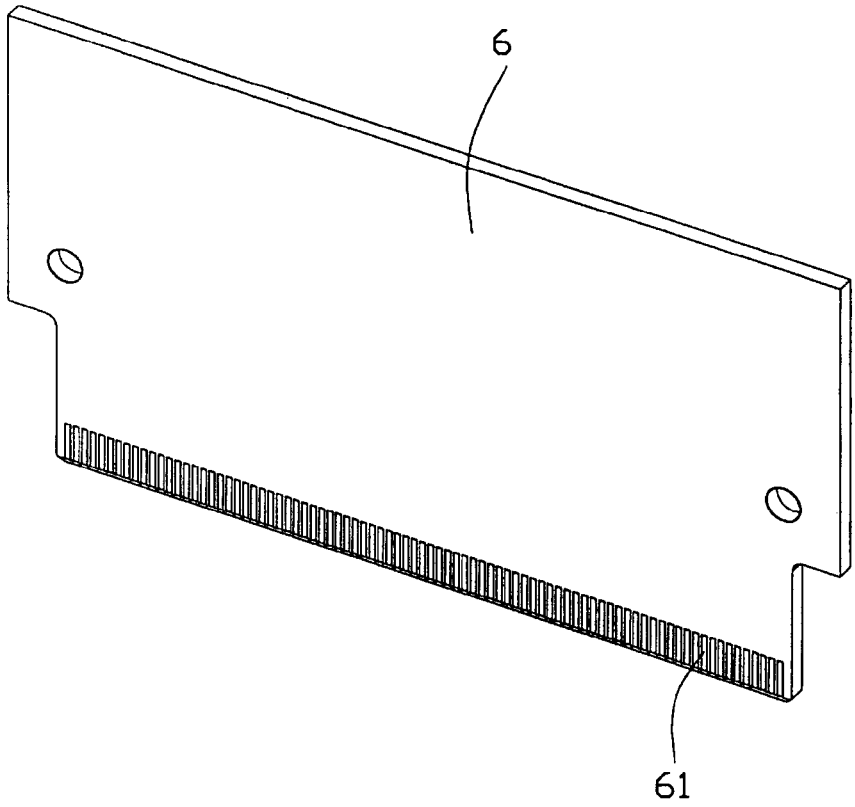
FIG. 4 is a perspective view of the electronic card as shown in FIG. 1.

Referring to FIG. 4, the electronic card 6 has a plurality of conductive pads 61 formed along a lower edge thereof.

Figure 5:
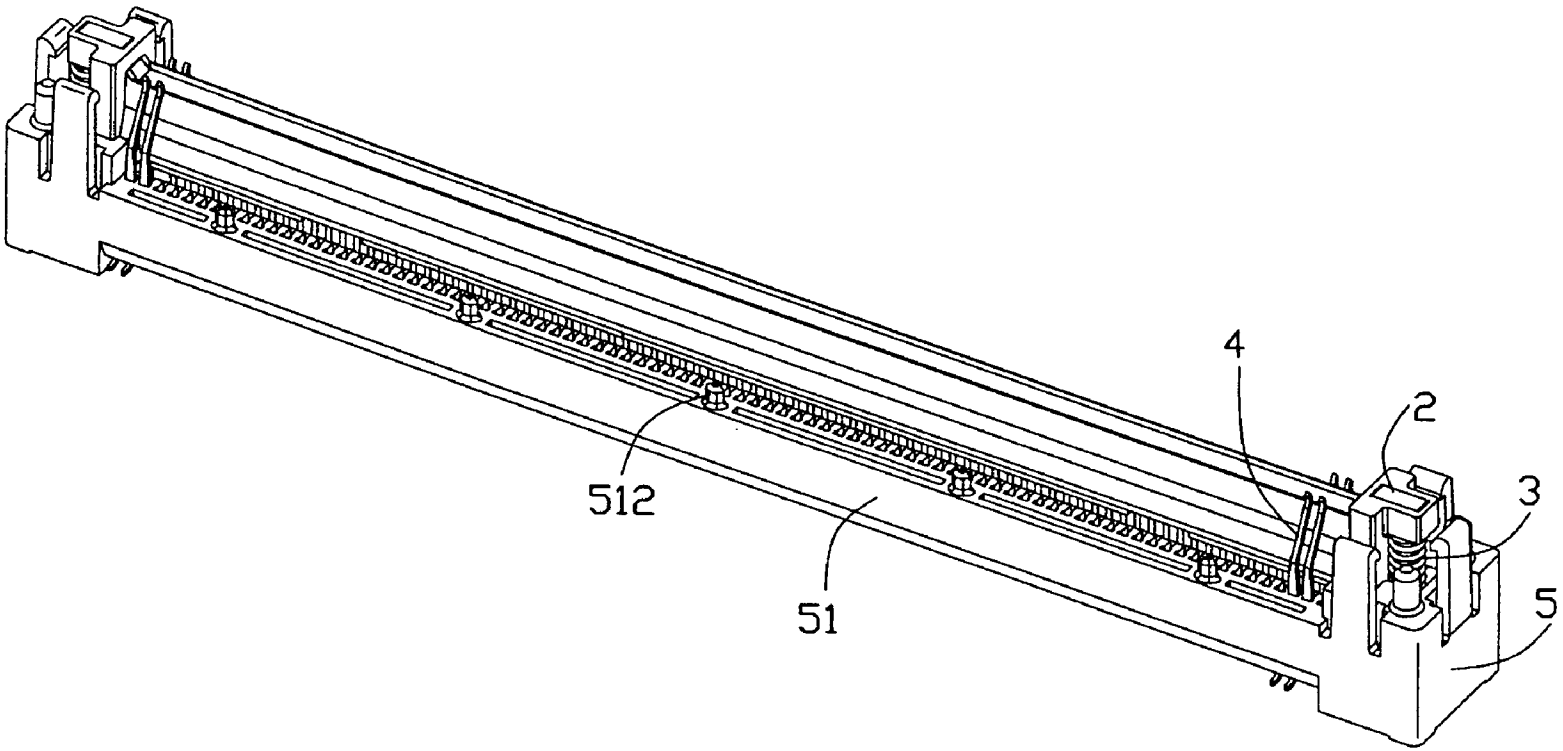
FIG. 5 is a partially assembled perspective view of the card connector assembly as shown in FIG. 2, with a first insulative housing being removed.
Figure 6:
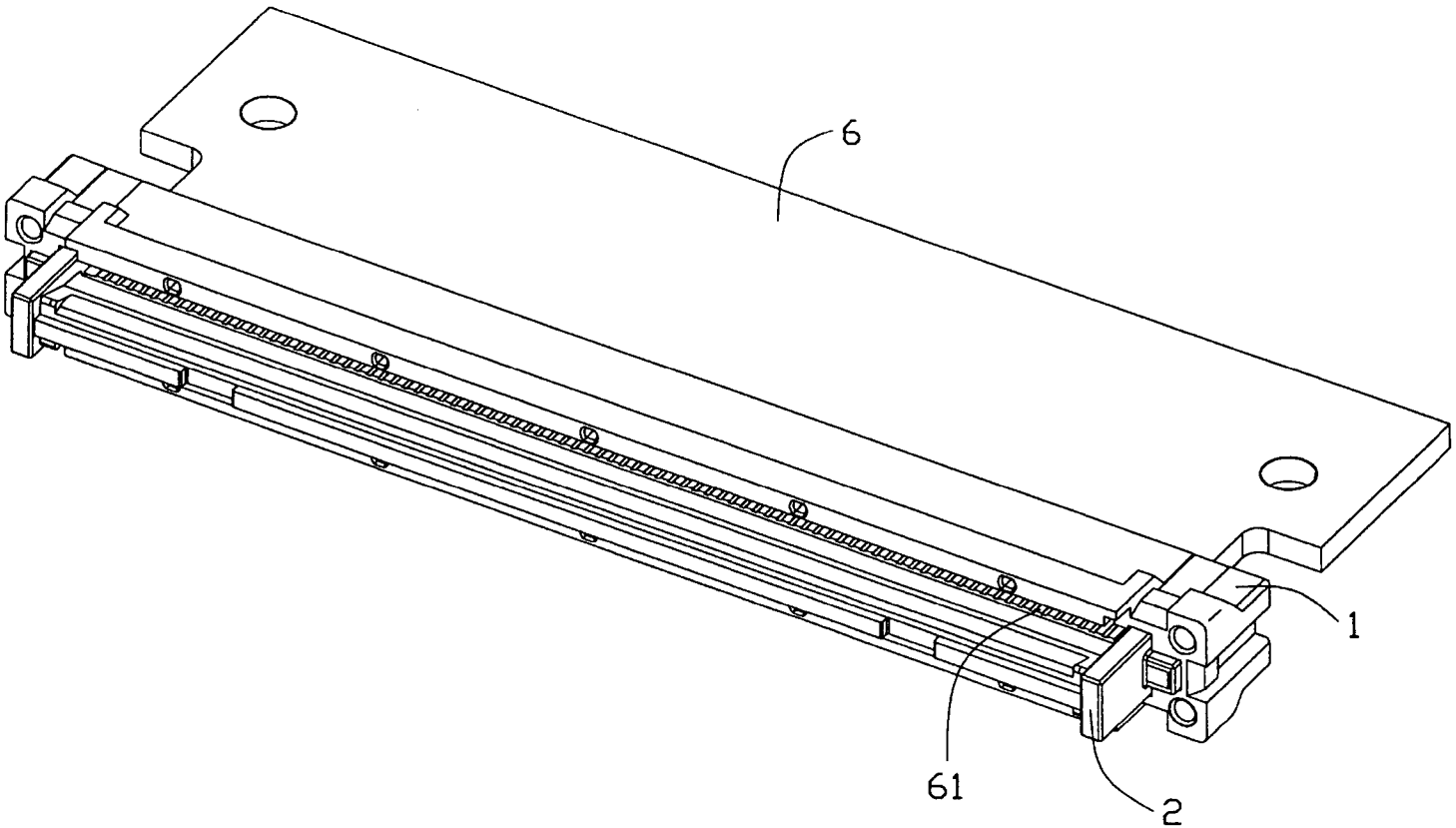

Referring to FIGS. 5-7, in conjunction with FIGS. 1-2, in assembly of the card connector assembly 100, the stiffener portion 22 is assembled to the moveable portion 21 firstly to form the carriage component 2. The body portion 221 of the stiffener portion 22 is inserted into the insertion recess 212 defined between the primary faces 211. The second ear portions 222 of the stiffener portion 22 are mounted within the first ear portions 2131 of the moveable portion 21. In the preferred embodiment, therefore, the pair of first ear portions 2131 and the pair of second ear portions 222 are combined as a pair of projection portions (not labeled). However, it is understood that either one of the two pairs of ear portions may properly serve as the projection portions in case only one pair of ear portions are provided on either the moveable portion 21 or the stiffener portion 22.

The carriage component 2 is mounted on the second insulative housing 5. The pair of coil springs 3 are assembled between the carriage component 2 and the second insulative housing 5, with one end thereof resisting against the second ear portions 222 and another end thereof being retained in the second slot 53. The first insulative housing 1 is mated with the second insulative housing 5, with the posts 522 being plunged into the indentations 121. The carriage component 2 is accommodated in the first slot 14, with the projection portions engaging with two ends of the first slot 14. The first locking portions 15 and the first hook 123 respectively engage with the second locking portions 521 and the second hook 523 for resisting an accidental unmating of the first insulative housing 1 from the second insulative housing 5. The receiving indentations 112 of the first insulative housing 1 couple with the protrusions 512 of the second insulative housing 5 for enhancing the engagement between the first and the second insulative housings 1, 5.

Two rows of the terminals 4 are mounted on the first and the second insulative housings 1, 5, with the body portions 41 being inserted into the first and the second passageways 111, 511 defined on opposite inner faces of the walls 11, 51, the contact portions 42 being exposed within the first slot 14, and the soldering portions 43 extending outwardly from the lower portion of the second insulative housing 5 for soldering onto a circuit board (not shown). The carriage component 2 is therefore confined between two rows of the terminals 4.

Referring to FIG. 7, when the electronic card 6 is not inserted into the card connector assembly 100, the carriage component 2 is upheld by the springs 3 and is disposed in the first slot 14. The top face 214 of the moveable portion 21 is disposed above the contact portions 42 of the terminals 4.

Once exerting an external force on the electronic card 6, the electronic card 6 is partially inserted into the first slot 14 in a top-to-bottom direction from the opening 13 until it reaches the top face 214 of the moveable portion 21. The electronic card 6 together with the carriage component 2 is held in an initial position.

Referring to FIG. 8, in operation, the electronic card 6 is urged to downwardly push the top face 214 of the moveable portion 21 under the external force to thereby move the carriage component 2 from the first slot 14 toward the second slot 53. During such a process, the contact portions 42 of the terminals 4 are exposed to contact with the electronic card 6 from an outer side of the carriage component 2. When the electronic card 6 is fully inserted in the second slot 53 to bring along the carriage component 2 from the initial position to a final position, the contact portions 42 of the terminals 4 are in contact with the conductive pads 61 of the electronic card 6, with the coil springs 3 being fully compressed. The electronic card 6 is then held in the final position.

The carriage component 2 would keep the contact portion 42 away from an insertion position of the electronic card 6, when the electronic card 6 is not inserted into the first slot 14. Therefore, the external force for insertion of the electronic card 6 among the terminals 4 does need to be very strong. The top face 214 of the carriage component 2 is disposed above the contact portions 42, when the carriage component 2 is disposed in the initial position. Therefore, the electronic card 6 would reach the top face 214 firstly before in contact with the contact portions 42 to thereby protect the terminal 4 from being broken, when the electronic card 6 is inserted incorrectly or is inserted under an excessive force.

During the process of insertion of the electronic card 6, the contact portions 42 of the terminals 4 engage with the conductive pads 61, but could not contact with other portions of the electronic card 6 to thereby protect the electronic card 6, due to a proper height of the carriage component 2.

When the electronic card 6 is removed from the electrical connector 100, the compressed springs 3 would provide a resilient force for easing removal of the electronic card 6.

However, the disclosure is illustrative only, changes may be made in detail, especially in matter of shape, size, and arrangement of parts within the principles of the invention.

What is claimed is:

1. A card connector assembly for insertion of an electronic card, comprising:

an insulative housing defining therein a cavity;

two rows of terminals assembled to opposite inner sides of the insulative housing, each terminal having a contact portion disposed in the cavity;

a carriage component being moveable between the two rows of terminals and having a pair of projection portions formed at two opposite ends thereof, said carriage component being movable along with an inserted electronic card from an initial position toward a final position where said carriage component is held stationary, wherein said carriage component comprises a stiffener portion having a top face resisting against the inserted electronic card, and wherein the pair of projection portion comprise a pair of second ear portions formed at two opposite longitudinal ends of the stiffener portion; and a pair of springs respectively assembled between corresponding projection portions and the insulative housing, said pair of springs positioned at two opposite longitudinal sides of the two rows of terminals.

2. The card connector assembly as claimed in claim 1, wherein said carriage component comprises a moveable portion having a top face resisting against the inserted electronic card, and wherein the pair of projection portions comprise a pair of first ear portions formed at two opposite longitudinal ends of the moveable portion.

3. The card connector assembly as claimed in claim 2, wherein said top face of the carriage component is disposed above the contact portions of the terminals when the carriage component is in the initial position.

4. The card connector assembly as claimed in claim 3, wherein said moveable portion has a pair of primary faces extending downwardly from the top face, a pair of connection faces respectively at side edges of the primary faces, an insertion recess defined between the primary faces, said first ear portions being formed on the connection faces.

5. The card connector assembly as claimed in claim 4, wherein said carriage component comprises a stiffener portion being integrated with the moveable portion and having a rectangular body portion retained in the insertion recess, and wherein the pair of projection portions comprises a pair of second ear portions projecting outwardly from the body portion for engaging with the first ear portions of the moveable portion.

6. The card connector assembly as claimed in claim 1, wherein said insulative housing comprises a first insulative housing and a second insulative housing mating with the first insulative housing, and wherein the cavity comprises a first slot defined within the first insulative housing, and a second slot defined within the second insulative housing.

7. The card connector assembly as claimed in claim 6, wherein said first and said second insulative housings respectively have a plurality of passageways extending in a top-to-bottom direction and communicating with the cavity defined in inner faces thereof, and wherein each terminal is formed with a soldering portion, a body portion retained in the passageway, and the contact portion, the contact portion being exposed within the first slot.

8. The card connector assembly as claimed in claim 7, wherein said first insulative housing is provided with a plurality of first locking portions, and wherein the second insulative housing is formed with a plurality of second locking portions cooperating with the first locking portions.

9. The card connector assembly as claimed in claim 7, wherein said first insulative housing has a plurality of receiving indentations defined on a bottom surface thereof, and wherein said second insulative housing is formed with a plurality of protrusions engaging with the receiving indentations.

10. The card connector assembly as claimed in claim 7, wherein said first insulative housing defines thereon a plurality of indentations, and wherein said second insulative housing is provided with a plurality of posts inserted into the indentations.

11. A card connector assembly for insertion of an electronic card, comprising:

an insulative housing defining therein a card receiving cavity;

two rows of terminals assembled to opposite inner sides of the insulative housing, each terminal having a contact portion disposed in the card receiving cavity;

a carriage component being movable between the two rows of terminals, said carriage component being movable along with an inserted electronic card from an initial position toward a final position where said carriage component is held stationary and the electronic card is sandwiched between and by said two rows of terminals;

wherein said carriage component comprising:

a movable portion with a pair of projections comprise a first ear portions, and an insertion recess defined therein;

a stiffener portion being integrated with the moveable portion and having a rectangular body portion retained in the insertion recess, and wherein a pair of projection portions comprises a pair of second ear portions projecting outwardly from the body portion for engaging with the first ear portions of the moveable portion; and at least one spring device being discrete and independent from the terminals and urging the carriage component upwardly; wherein the carriage component moves from the final position to the initial position by the spring means and outwardly deflects the two rows of terminals when the card is removed from the card receiving cavity.

12. The card connector assembly as claimed in claim 11, wherein friction forces between the terminals and the inserted card are larger than an upward force generated by the spring means.

13. The card connector assembly as claimed in claim 11, wherein there are two said spring devices respectively located at two opposite longitudinal ends of the housing.

* * * * *